US008714383B2

(12) United States Patent
Corson

(10) Patent No.: US 8,714,383 B2
(45) Date of Patent: May 6, 2014

(54) COMPOUND BUNG FOR WINE AND SPIRITS BARRELS

(75) Inventor: Donald L. Corson, Port Angeles, WA (US)

(73) Assignee: Corson Family Enterprises, LLC, Port Angeles, WA (US)

( * ) Notice: Subject to any disclaimer, the term of this patent is extended or adjusted under 35 U.S.C. 154(b) by 0 days.

(21) Appl. No.: 13/544,831

(22) Filed: Jul. 9, 2012

(65) Prior Publication Data

US 2013/0043215 A1 Feb. 21, 2013

Related U.S. Application Data

(60) Provisional application No. 61/525,648, filed on Aug. 19, 2011.

(51) Int. Cl.
*B65D 39/00* (2006.01)

(52) U.S. Cl.
USPC ..... 215/364; 220/804; 220/801

(58) Field of Classification Search
USPC ..... 220/789, 790, 791, 801, 802, 803, 804, 220/805; 215/364, 355, 296, 294
See application file for complete search history.

(56) References Cited

U.S. PATENT DOCUMENTS

| | | | | | |
|---|---|---|---|---|---|
| 189,073 | A | * | 4/1877 | Tully | 215/364 |
| 214,987 | A | | 5/1879 | Barrett et al. | |
| D24,447 | S | * | 7/1895 | Lowrey | D9/439 |
| 602,822 | A | * | 4/1898 | Boynton et al. | 215/306 |
| 701,101 | A | * | 5/1902 | Stutz | 215/355 |
| 794,478 | A | * | 7/1905 | Abbott | 215/364 |
| 2,192,511 | A | * | 3/1940 | Thomas | 215/364 |
| 2,634,014 | A | * | 4/1953 | Kimber | 215/262 |
| 2,822,104 | A | * | 2/1958 | Busch | 215/360 |
| 3,348,720 | A | * | 10/1967 | Richardson | 217/108 |
| 3,438,531 | A | * | 4/1969 | Millard et al. | 217/110 |
| 3,473,686 | A | * | 10/1969 | Kusserow | 217/108 |
| 3,618,814 | A | * | 11/1971 | Nagroski | 220/804 |
| 3,628,681 | A | * | 12/1971 | Schwartz | 215/364 |
| 3,742,898 | A | * | 7/1973 | Souza | 116/268 |
| 3,982,649 | A | * | 9/1976 | Wanderer | 217/108 |
| 3,982,651 | A | * | 9/1976 | Braun et al. | 220/4.21 |
| 4,131,277 | A | | 12/1978 | Randolph | |

(Continued)

OTHER PUBLICATIONS

Wikipedia, (redirected from Hard Rubber) Ebonite, http://en.wikipedia.org/wiki/Ebonite.

*Primary Examiner* — Fenn Mathew
*Assistant Examiner* — Christopher McKinley
(74) *Attorney, Agent, or Firm* — Jacques M. Dulin, Esq.; Innovation Law Group, Ltd.

(57) ABSTRACT

Compound bung-type stopper assemblies for wine and spirits barrels, comprising a body having an enlarged head portion, a reduced, tapered neck portion and a tapered, disposable elastomeric cup that snugly fits over the neck. The taper permits the inventive compound bung to be universal in fit and the elastomeric material of the cup grippingly conforms to bunghole irregularities. The body can be re-used with multiple cups, each being dedicated to a different wine or spirit, or after the cup has worn out. Body materials are selected from any essentially low- or non-resilient material, including glass, hard plastic (such as polycarbonate), wood, metal or ceramic, and may be colored. The head may be domed or flat, and may be decorated, as by etching, embossing or painting with the winemakers or winery mark. The inventive compound bungs/bodies that are identified by such marks may be sold as collectibles or as commemorative devices.

14 Claims, 3 Drawing Sheets

(56) References Cited

U.S. PATENT DOCUMENTS

| | | | | |
|---|---|---|---|---|
| 4,363,416 | A * | 12/1982 | Loughmiller | 215/364 |
| 4,546,894 | A * | 10/1985 | Suinat et al. | 215/354 |
| 4,826,029 | A * | 5/1989 | Skoglie | 217/110 |
| 5,109,997 | A * | 5/1992 | Phillips | 215/360 |
| 5,596,814 | A * | 1/1997 | Zingle et al. | 34/296 |
| 5,947,326 | A * | 9/1999 | O'Hern et al. | 220/802 |
| 5,975,322 | A * | 11/1999 | Reid | 215/273 |
| 6,168,036 | B1 * | 1/2001 | Teng | 215/296 |
| 6,183,982 | B1 * | 2/2001 | Nastasia | 435/41 |
| 6,286,699 | B1 * | 9/2001 | Sudo | 215/364 |
| D458,843 | S * | 6/2002 | Jensen | D9/440 |
| 6,482,894 | B1 | 11/2002 | Chang et al. | |
| 6,601,722 | B1 * | 8/2003 | Litoux-Desrue et al. | 215/364 |
| 6,613,406 | B1 * | 9/2003 | Yaniger | 428/34.4 |
| 6,805,256 | B1 * | 10/2004 | Plasterr | 220/801 |
| D639,607 | S * | 6/2011 | Bracq | D7/397 |
| 8,356,722 | B2 * | 1/2013 | Dubs et al. | 215/277 |
| 2002/0014468 | A1 * | 2/2002 | Stroppiana | 215/355 |
| 2002/0153342 | A1 * | 10/2002 | Fragola | 215/364 |
| 2002/0195910 | A1 | 12/2002 | Hus et al. | |
| 2004/0112856 | A1 * | 6/2004 | Hwang et al. | 215/361 |
| 2004/0169001 | A1 * | 9/2004 | Leendersten et al. | 215/355 |
| 2004/0238479 | A1 * | 12/2004 | Caswell et al. | 215/364 |
| 2006/0261029 | A1 * | 11/2006 | Casini et al. | 215/355 |
| 2008/0078737 | A1 * | 4/2008 | Brennan et al. | 215/364 |
| 2008/0272085 | A1 * | 11/2008 | Laporta | 215/296 |
| 2008/0277373 | A1 * | 11/2008 | Gibis et al. | 215/364 |
| 2009/0039052 | A1 * | 2/2009 | Galvez-Ramos | 215/356 |
| 2011/0108512 | A1 * | 5/2011 | Cabral et al. | 215/364 |

* cited by examiner

COMPOUND BUNG FOR WINE AND SPIRITS BARRELS

CROSS-REFERENCE TO RELATED CASE

This is the Regular U.S. Application corresponding to U.S. Provisional Application Ser. No. 61/525,648 Filed Aug. 19, 2011, by the same inventor under the same title, the priority of which is claimed under 35 USC §119 ff.

FIELD

This invention relates to universal stoppers for wine, beer, cider and spirits barrels, commonly called "bungs", and more particularly to compound stopper assemblies comprising a body having an enlarged head portion and a reduced, tapered neck portion and a tapered elastomeric cup that snugly fits over the neck portion and which is replaceable or/and disposable. The elastomer covered neck fits in the bunghole of the barrel side wall. The taper permits fitting the bung in a wide range of bunghole sizes (diameters), and the elastomeric material of the cup grippingly conforms to bunghole irregularities. A preferred body material is glass, but may be any essentially low- or non-resilient material, including but not limited to hard plastic (such as polycarbonate), wood, metal or ceramic.

BACKGROUND

A bunghole is a hole bored the head-end or in a side stave of a liquid-tight wooden barrel. The hole is capped with a large cork-like object called a bung. Bungholes were first used on wooden barrels, and were typically bored by the purchaser of the barrel using a brace and bit. Bungholes can be bored in either head (end) of a barrel or in one of the staves (side). With the bung removed, a tapered faucet can be attached to aid with dispensing. When barrels full of a commodity such as wine, beer or spirits were shipped, the recipient would often bore new bungholes of the most suitable size and placement rather than remove the existing bung. Wooden barrels manufactured by specialty firms today usually are bored by the maker with suitable bungholes, since the users who purchase them for the making of beer, wine, and fermented foods often do not have a suitable brace and bit. Indeed, pre-drilled barrel bung holes are now the industry standard.

Wine and spirits barrel bungs are traditionally made of cork, wood or a slightly resilient plastic, and are monolithic in nature and configuration. A bung is truncated cylindrical or conical closure to seal a container, such as a bottle, tube or barrel. Unlike a lid which encloses a container from the outside without displacing any inner volume, a bung is partially inserted into the container from the exterior to act as a seal. A rubber stopper is sometimes called a rubber bung, and a cork stopper is called a cork. Stoppers used for wine bottles are typically referred to as "corks", even though made from another material, typically a specialty plastic that has the correct modulus of elasticity to permit the high degree of compression to fit into the neck of the bottle and thereafter expand to make a tight seal.

When the hole to be sealed is large, as in the case of a barrel, the stopper is called a bung. When small, such as the stopper of a wine bottle they are called plugs, stoppers or corks. Other bungs, particularly those used in chemical barrels, may be made of metal and are screwed into place via threading, or may be made of hardened rubber. Other types of all-plastic plugs are commonly used to prevent the air from leaking out the filler tube of an inflated air-bed. This type of stopper is commonly made in two parts; the plastic outer screw-on cap and the inner rubber plug or stopper used to seal the tubing.

Glass stoppers are used in chemistry applications and in some decanters of wine or spirits. Typically the sides of the stopper and the inner matching bore of the chemical flask or decanter are ground with mating tapers to provide an air and fluid tight seal.

However, wine and spirit barrel bungs are commodity items, usually not made with any precision, and may ordinarily be seated with wood or leather mallets. They often crack upon use and are considered a disposable item. In the case of elastomeric bungs, they may include an exterior flange to prevent them from being pushed inside the barrel as they deform too easily, and care must be taken in setting them properly in the bunghole, seated deeply enough that they make a good seal, but not so deep that they cannot be removed. This is particularly problematic in the case of wine and spirits aging, where the bung must seal tightly, but also protrude enough to provide a hand-grippable projecting portion.

Accordingly, there is a need in the art for a bung that is universal in size, provides a tight edge seal when seated in a bunghole of both new and older, used barrels, is easily graspable by hand, and is resistant to being over-seated and lost inside the barrel.

THE INVENTION

Summary, Including Objects and Advantages

The invention is directed to universal stoppers for wine, beer, cider and spirits barrels, commonly called "bungs", and more particularly to compound bung assemblies comprising: 1) a body having an enlarged head portion and a reduced, tapered neck portion, and 2) a tapered, external elastomeric cup that snugly fits over the neck portion. The enlarged head portion is large enough in diameter and long enough to be easily and comfortably grasped by hand for insertion and removal. The elastomer-covered neck fits in the bunghole, whether bored in a stave of the barrel side wall or in the barrel end. The tapered neck permits fitting the bung in a wide range of bunghole sizes (diameters), and the elastomeric material of the cup grippingly conforms to bunghole irregularities. A preferred body material is glass, but may be any essentially low- or non-resilient material, including but not limited to hard plastic (such as polycarbonate), wood, metal or ceramic.

In the exemplary implementation embodiment described herein the body or core material is glass. The body includes an upper head portion and a lower stem portion. The stem portion has an outer diameter that is smaller than the bunghole diameter and smaller than the outer diameter of the head portion, as seen in plan view. The stem joins the head at a shoulder, which comprises a horizontal annulus spanning between the smaller diameter of the stem and the larger diameter of the head side wall.

The top of the head portion may be smoothly rounded or may be flat with chamfered circumferential edge where the top flat surface meets the side wall of the head portion. The head portion is on the order of 2"-5" in height so that there is enough sidewall gripping surface to be engaged by the thumb and first two fingers of the winemaker for insertion and removal. The outer diameter is typically 2.25" in diameter and may range from about 1.75" to about 3" in diameter, depending on the barrel and bunghole size.

The stem portion is on the order of 1¼-2" in length and tapers on the order of from about 5 to about 10°, for example from about 1.25" in diameter at the bottom end to about 1.75" in diameter at the shoulder. The bottom face of the stem is preferably flat, so that it may be stored, shipped or set bottom-face-down on a surface preparatory to use or upon removal from a bunghole while the barrel wine or spirits are being sampled or tested.

The elastomeric cup preferably has a uniform wall thickness, typically on the order of 5 mm thick, but may range from about 3 mm to about 10 mm in thickness. The cup inside bottom diameter matches the diameter of the bottom end of the stem, and the top matches the diameter of the stem slightly below the shoulder, typically on the order of 1-3 mm below the shoulder so that there is a small gap between the top lip of the cup and the shoulder. This provides a compression deformation space or gap into which the elastomer of the cup may expand when press-fit into the bunghole.

An important aspect of the invention is that the essentially non-compressive, dense body forms a non-deformable, heavy core as to which substantial pressure may be applied, yet the outer deformable elastomeric cup provides a very good seal, even to rough surfaces, such as the raw wood of wine and spirit barrels. In addition, the substantial vertical extent of the head portion glass provides an aesthetically-pleasing projection in addition to be easily graspable for insertion, removal and general handling. Finally, the head surfaces, both the top, whether rounded or flat, and the side walls, may be etched, inscribed or printed with winery, winemaker or vintage information. The glass may be clear or colored, and as such internally reflects light, making for a very visually appealing display. As so inscribed or printed, the inventive compound bungs may also be collectible and keepsake items.

For high-end, collectible, signature and limited editions, the inventive bung bodies may be made of metal, such as bung bodies of aluminum, brass, bronze, iron, steel or precious metal (including alloys), enameled or glazed bung bodies, or precious metal-plated or clad bungs made of glass, ceramic or metal. Examples include: glass bungs with gold, silver or platinum printing or plating of the winery trademark (for example); ceramic bungs with gold, silver or platinum glaze or coatings; or precious metal (including alloys), precious metal-plated, or precious metal clad bungs (e.g., a vermeil bung); brass bungs with cloisonné decorations; or plique-a-jour heads on bung bodies. The inventive bung bodies permit a wide range of design and materials creativity.

The inventive compound bungs may also be sized and used for wine and spirits bottle and carafe stoppers, e.g. from 750 ml size to jereboams. In addition, "miniatures" of any size, such as ¾, ½ or ¼ sized "miniatures", may be used for displays, as collectibles, as gifts, or as commemoratives of the winemaker, a "cellar", or vineyard.

BRIEF DESCRIPTION OF THE DRAWINGS

The invention is described in more detail with reference to the photographs and drawings, in which.

DETAILED DESCRIPTION, INCLUDING THE EXEMPLARY MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be commercial implementations of the invention.

Figure 1:
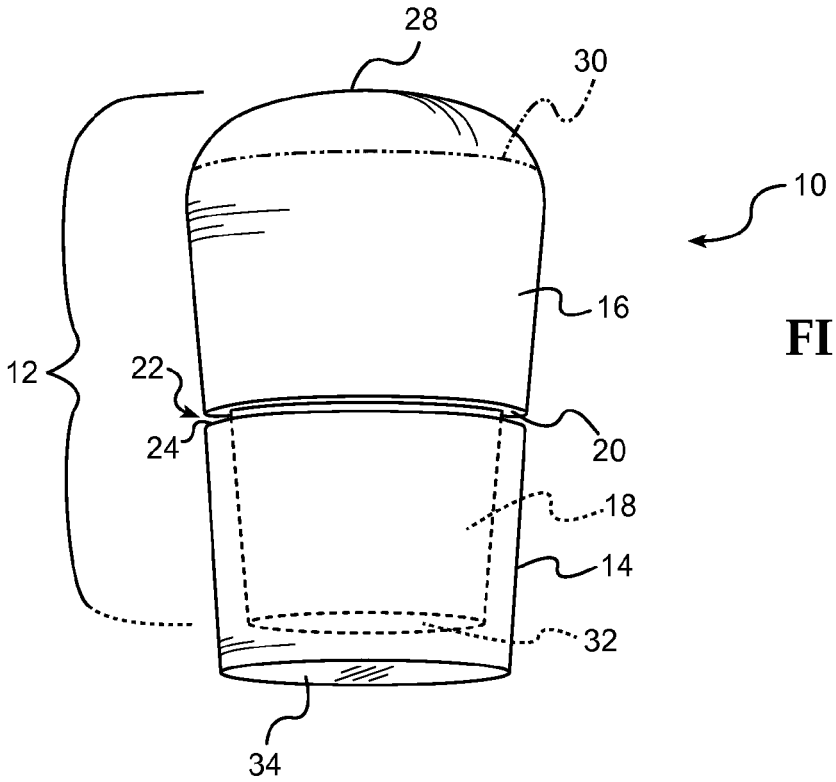
FIG. 1 is a side elevation photo of the inventive compound bung with the elastomeric cup fitted onto the stem, and showing the gap between cup top lip and shoulder.

FIG. 1 shows in side elevation a first embodiment of the inventive compound bung assembly 10 comprising a body or core 12 and an elastomeric cup 14. The body 12 includes a head portion 16 and a stem portion 18, demarcated by a horizontal annular shoulder 20. Preferably there is a small gap 20 between the shoulder 18 and the top lip of the cup 24.

Figure 2:
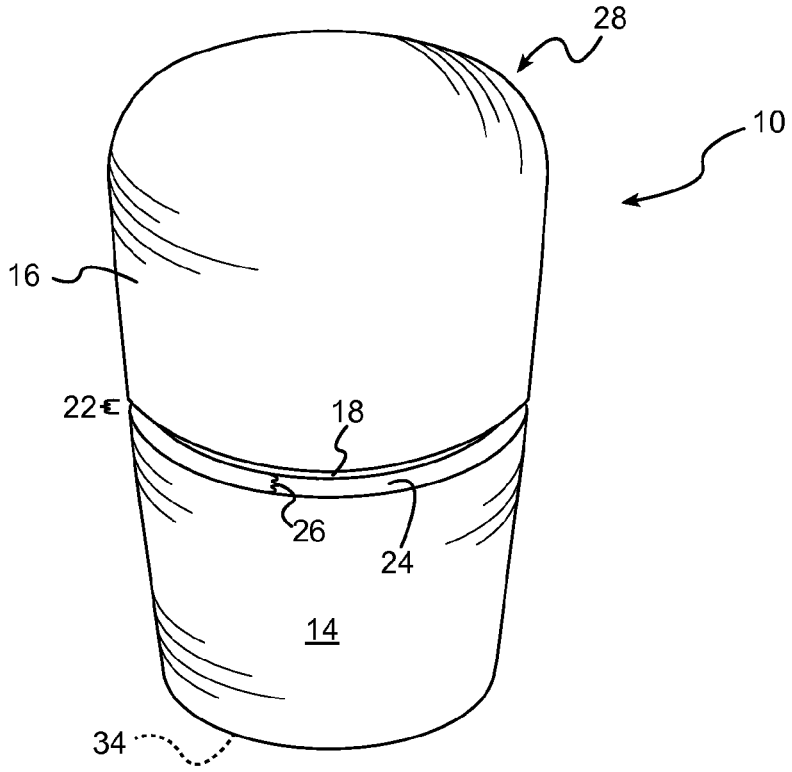
FIG. 2 is an isometric photo of the inventive compound bung of FIG. 1 clearly showing the spaced top lip and wall thickness of the elastomeric cup member.

FIG. 2 shows in isometric view the compound bung assembly of FIG. 1, with the parts numbered as before. An upper sliver of the stem portion 18 is visible in this view, as is the thickness 26 of the elastomeric cup 14.

FIG. 1 also shows in dashed lines the profile of the stem 18. It also illustrates the dome shaped top surface 28 of the head portion 16. In an alternate embodiment, the head top surface may be flat 30, as shown in FIG. 1 in dash-dot line. Note the bottom surface 32 of the stem is formed as a flat horizontal surface, and the bottom of the cup 34 is also flat. As seen in FIG. 2 the inventive compound bung, as assembled, can rest upright and stable on the flat bottom 34 of the cup.

Figure 3:
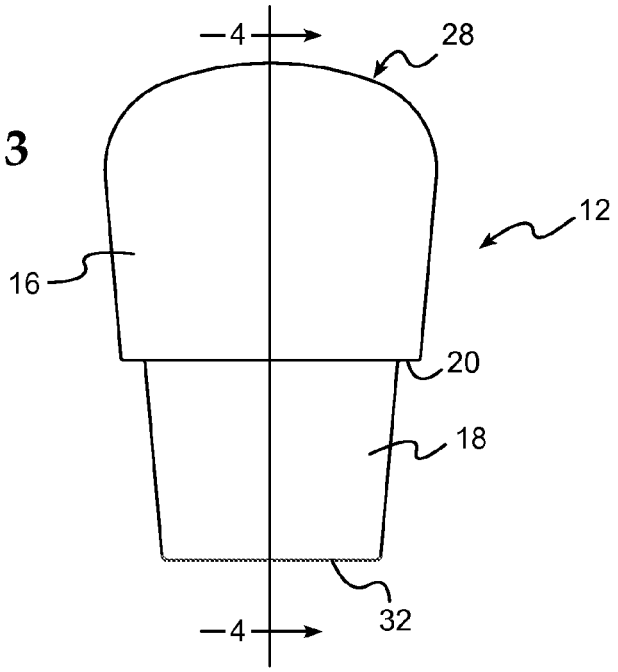
FIG. 3 is a side elevation drawing of the body showing the head and stem portions of the body and the shoulder.
Figure 4:
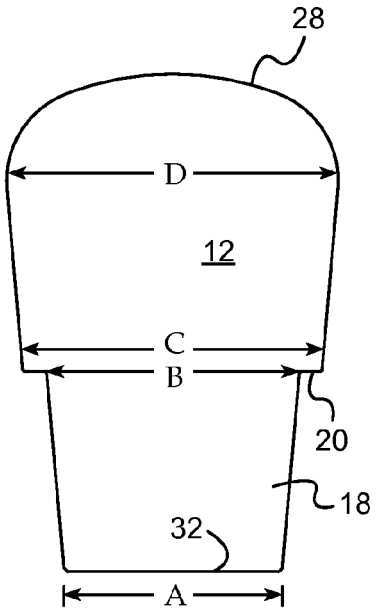
FIG. 4 is a vertical section view drawing of the body along the lines 4-4 of FIG. 3.

FIG. 3 shows in line drawing the side elevation of the body, while FIG. 4 is a section view of the body 12 taken along line 4-4 of FIG. 3. As seen in FIG. 4, the body in a first embodiment is solid, monolithic; in this implementation, glass, which also has a refractive property which is highly decorative when illuminated. Note the diameters shown in FIG. 4: The base of the stem diameter A is less than B, which is the stem diameter at the shoulder 20, resulting in a taper permitting the stem, when fitted with a similarly tapered cup, to universally fit a wide range of bunghole sizes. It can be easily understood by those skilled in the art that it is a straight forward matter to select the desired degree of taper to fit the barrel bungholes with which they are dealing. Note also that the head is tapered, with the diameter at the shoulder C being smaller than the widest portion D, just below the uppermost point of the arc(s) that form the domed top surface 28. The domed top surface may be a single, continuous arc, such as a semi-circle, or may be compound, as best seen in FIG. 3.

Figure 5:
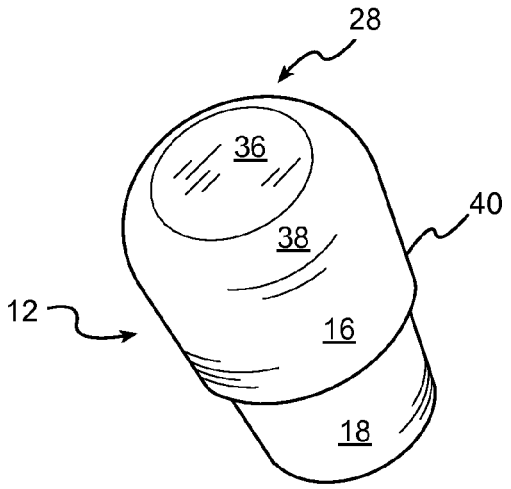
FIG. 5 is an isometric drawing of the body of FIGS. 3 and 4.

FIG. 5 is an isometric line drawing of the inventive bung showing the top surface 28 is a compound dome, comprising a central portion 36 having a shorter radius of curvature than an outer annulus 38 which blends with the side wall 40 of the head portion 16. One or more of the top and side surface(s) may be faceted for a distinctive, identifying function.

Figure 6:
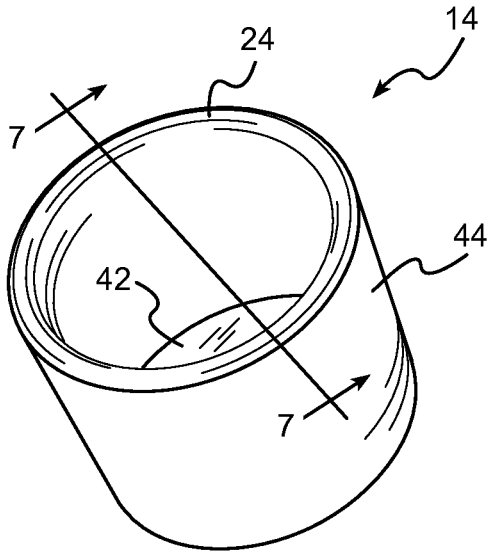
FIG. 6 is an isometric drawing of the cup element of the inventive combination compound bung of FIGS. 1 and 2.

FIG. 6 is an isometric view of the cup 14, showing the interior bottom 42 is flat and conforms to the bottom of the stem 32. Likewise the circumferential side wall 44 is tapered and of uniform thickness to provide a good friction fit with the stem 18, as seen in FIGS. 1, 3 and 5.

Figure 7:
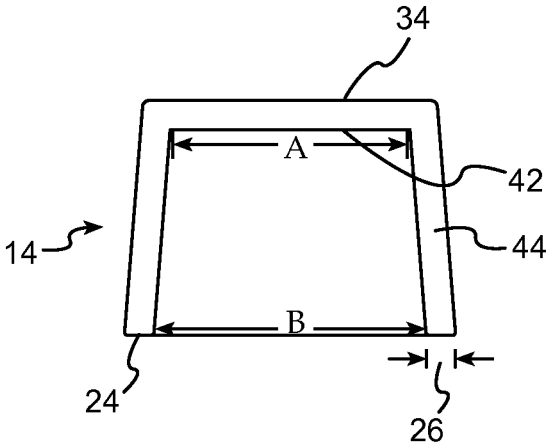
FIG. 7 is a vertical section drawing showing the cup in the inverted position before assembly onto the stem of the body to result in the combination of FIGS. 1 and 2.

As seen in FIG. 7, a section view along the line 7-7 of FIG. 6. The cup diameter A at the juncture of the cup bottom 42 with the side wall 44, is the same as the diameter A of the stem. Likewise the cup opening diameter B is slightly less than the diameter of the stem 18 as it transitions into the annulus of the shoulder 20, the amount by which it is slightly less depends on the size of the gap 22 (seen in FIG. 1), and how snug a fit on the stem is desired.

It is important to note that the cup portions 14 are disposable. Thus, when the outer surface of the cup becomes abraded or discolored after use, it may be thrown away, and a second cup fitted on the stem. Thus, the compound bung core can be used equally and repeatedly for white or red wine, with the cups being changed out as needed. That is, in the current practice, a bung is dedicated to a particular type or variety of wine grape in the barrel, and cannot be switched, say from red to white.

The top surface area of the head 36 may be engraved with winery, vintage or vintner's trademarks. The glass is highly refractive, making a pleasing presentation when illuminated. For example, the glass can be ruby colored for red wine barrels, rose colored for rosé wine, and clear or pale yellow for white wines. It can be amber or dark brown for beers, depending on the type. If the winery or brewery has a trademark color, such as royal purple, lavender, green, blue or the like, the body glass can be appropriately colored for that identifying function. In addition the glass light transmissivity ranges from transparent to translucent, or it may be opaque.

The cup elastomer preferably has a light transmissivity ranging from transparent to trans-lucent, although it may be opaque. For example, where the barrel contents are light sensitive, the cup may include a black colorant, such as carbon black, to prevent light transmission through the glass bung into the barrel. The top surface of the bung head may include indicia linking said barrel contents to a least one of a trademark, a cellar or maker's mark (brewer, winery or vintner), the contents type or name, the contents vintage, a year date, a sponsorship, and indicia of a collectible or commemorative nature. The indicia is suitably formed from at least one of casting, cutting (e.g., with diamond wheel), engraving, printing, and sand-blasting. The exterior surface of at least one of the top and side wall of the glass body may be faceted.

INDUSTRIAL APPLICABILITY

It is clear that the inventive compound bung of this application has wide applicability to the wine and spirits industry, namely to winemaking and spirits ageing and to retail cellars in which customer visits for ambience is important. The compound bung system clearly has the advantage of being universal as to taper and size, and the cups, being disposable, permit the body to be used for multiple different types of wine or spirits, simply by use of different cups, one for each type or variety product being barrel aged. Thus, the inventive compound bung system has the clear potential of becoming adopted as the new standard for barrel closures in these industries.

It should be understood that various modifications within the scope of this invention can be made by one of ordinary skill in the art without departing from the spirit thereof and without undue experimentation. For example, the decorative indicia painted, glazed or etched can have a wide range of designs to provide the esthetics and functionalities disclosed herein. This invention is therefore to be defined by the scope of the appended claims as broadly as the prior art will permit, and in view of the specification if need be, including a full range of current and future equivalents.

PARTS LIST

This Parts List is Provided as an Aid to Examination and May be Canceled Upon Allowance 10 Inventive compound bung assembly
12 Body or core
14 Elastomeric cup
16 Head portion of body
18 Stem portion of body
20 Shoulder
22 Gap
24 Top lip of cup 14
26 Wall thickness of cup 14
28 Rounded top surface (dome) of head portion
30 Alternative flat top surface of head portion
32 Flat bottom of stem
34 Flat bottom of cup
36 Center cap of compound dome
38 Annulus of dome
40 Side wall of head (optionally tapered)
42 Cup bottom
44 Cup side wall
46
48
50
52
54
56
58
60
62
64
66
68
70
72
74
76
78
80
82
84
86
88
90
92
94
96
98
100
102
104
106
108
110
112
114
116
118
120
122
124
126
128
130
132
134
136
138
140
142
144
146

-continued

| |
|---|
| 148 |
| 150 |
| 152 |

The invention claimed is:

1. A compound bung assembly configured for bunghole closures for wine, beer, cider and spirits barrels, consisting essentially of:

a) a generally cylindrical, elongated, non-resilient body member having:

i) an upper head portion larger in diameter than the diameter of a barrel bunghole so that said head portion cannot be pushed into said barrel, said head portion having a top surface, a central vertical axis and an axial length permitting grasping by hand for insertion and removal from said barrel bunghole;

ii) a reduced neck portion extending below said upper head portion, said neck portion is smaller in diameter than the diameter of said bung-hole;

iii) said head portion terminating in an annular shoulder portion at the junction with said neck portion, said annular shoulder portion being generally planar and oriented horizontally orthogonal to said vertical axis of said head portion so that said shoulder is inset into said body at said junction and forms generally a right angle to said head and neck portions;

iv) said neck portion having an axis oriented as a coaxial continuation of the axis of said head portion and an axial length substantially longer than the thickness of said barrel wall surrounding said bunghole;

v) said neck portion having an outward taper angle commencing at a lower terminus end of said neck portion and extending to said shoulder portion junction with said head portion, the widest diameter of said neck portion being at said shoulder junction, and said widest neck diameter is less than the diameter of said head portion at said shoulder junction;

b) said body consists essentially of monolithic material selected from glass, rigid plastic, metal and ceramic; and c) a replaceable and disposable elastomeric cup member matingly tapered to snugly fit said neck portion of said body, said elastomeric cup having a sidewall thickness in the range of from about 3 to about 10 mm, said elastomeric material having a resilience sufficient to permit it to directly grippingly engage a wood wall of a bunghole to seal irregularities, said elastomeric cup member outer surface being configured so that its outer tapered surface is co-planar with the tapered outer surface of said head portion and said elastomeric cup material not including hard rubber.

2. A compound bung assembly as in claim 1 wherein said head portion top surface is generally rounded in profile as seen in vertical cross-section.

3. A compound bung assembly as in claim 1 wherein said cup sidewall is substantially the same thickness as said shoulder portion annulus.

4. A compound bung assembly as in claim 1 wherein said head portion has tapered side wall.

5. A compound bung assembly as in claim 4 wherein said head portion taper angle is the same as said elastomeric cup outside wall taper angle.

6. A compound bung assembly as in claim 2 wherein said body is glass.

7. A compound bung assembly as in claim 1 wherein said cup elastomer is polyurethane and its light transmissivity ranges from transparent to translucent.

8. A compound bung assembly as in claim 6 wherein said cup elastomer is polyurethane and its light transmissivity ranges from transparent to translucent.

9. A compound bung assembly as in claim 6 wherein said cup elastomer is polyurethane and it is opaque to prevent light transmission into said barrel contents.

10. A compound bung assembly as in claim 1 wherein said top surface of said head portion includes indicia linking said barrel contents to a least one of a trademark, a cellar or maker's mark, the contents type or name, the contents cru, a year date, a sponsorship, and a collectible or commemorative nature.

11. A compound bung assembly as in claim 10 wherein said head portion top surface is generally rounded as seen in vertical profile.

12. A compound bung assembly as in claim 1 wherein said body is glass selected from clear and colored.

13. A compound bung assembly as in claim 12 wherein the exterior surface of at least one of said top and said side wall of said body is faceted.

14. A compound bung assembly as in claim 10 wherein said indicia is formed selected from at least one of casting, cutting, engraving, printing, and sand-blasting.

* * * * *